US006505022B2

(12) United States Patent
Kosuge et al.

(10) Patent No.: US 6,505,022 B2
(45) Date of Patent: Jan. 7, 2003

(54) IMAGE FORMING APPARATUS HAVING PROTECTIVE LAYER ON THE SURFACE OF IMAGE BEARING MEMBER TO AVOID ADHESION OF FILM OF ADDITIVES TO IMAGE BEARING MEMBER

(75) Inventors: Akio Kosuge, Yokohama (JP); Masumi Sato, Yokohama (JP); Hitoshi Ishibashi, Tokyo (JP); Hiroshi Yoshinaga, Ichikawa (JP); Yukiko Iwasaki, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 09/810,565

(22) Filed: Mar. 19, 2001

(65) Prior Publication Data

US 2001/0022905 A1 Sep. 20, 2001

(30) Foreign Application Priority Data

Mar. 17, 2000 (JP) ..... 2000-077297

(51) Int. Cl.[7] ..... G03G 21/00; G03G 21/10; G03G 15/08

(52) U.S. Cl. ..... 399/159; 399/99; 399/258; 399/359; 399/120; 222/DIG. 1

(58) Field of Search ..... 399/92, 99, 100, 399/101, 116, 119, 120, 159, 252, 253, 254, 258, 259, 358, 359, 360; 430/110, 111

(56) References Cited

U.S. PATENT DOCUMENTS 5,960,246 A * 9/1999 Kasahara et al. ..... 399/359
6,058,282 A * 5/2000 Ghosh et al. ..... 399/159
6,137,977 A * 10/2000 Okado et al. ..... 399/252

FOREIGN PATENT DOCUMENTS

JP 11-202538 7/1999
JP 11-258961 9/1999
JP 11-282236 10/1999

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes an image bearing member on which an electrostatic latent image is formed, the image bearing member including a protective layer on a surface thereof, a developing device configured to develop the electrostatic latent image with toner to which an external additive is added to form a toner image, and a toner replenishing device configured to contain the toner and to supply air to the toner to replenish the developing device with the toner.

40 Claims, 6 Drawing Sheets

IMAGE FORMING APPARATUS HAVING PROTECTIVE LAYER ON THE SURFACE OF IMAGE BEARING MEMBER TO AVOID ADHESION OF FILM OF ADDITIVES TO IMAGE BEARING MEMBER

BACKGROUND OF THE INVENTION

1. Field of the Invention

The present invention relates to an image forming apparatus wherein a developing device develops an electrostatic latent image formed on an image bearing member with toner to form a toner image.

2. Discussion of the Background

An image forming apparatus such as a copying machine, a printer, a facsimile, or a multifunctional image forming apparatus having at least two functions out of copying, printing, and faxing is known. Such an image forming apparatus forms toner images on a transfer material, for example a transfer sheet, by the following process steps: electrostatically forming a latent image of an image on an image bearing member; developing the latent image with toner by a developing device; and transferring the toner image to a transfer material by a transferring device.

When a toner replenishing device that contains powdered toner and supplies air to the toner to replenish a developing device with the toner is provided in the above-described image forming apparatus, the toner replenishing device allows the toner to be replenished to the developing device from a toner container provided at a distance from the developing device, and a space between the developing device and the toner container can be effectively used in the image forming apparatus. As a result, elements of the image forming apparatus can be designed with numerous layouts, and operability of the image forming apparatus can be enhanced.

Referring further to the above-described toner replenishing device, because fluidity of the toner is increased by supplying air to the toner, the toner is smoothly and effectively conveyed and replenished to the developing device.

In order to surely increase the fluidity of the toner, it is necessary to add a large quantity of external additives to the toner. In this case, the toner including the external additive can be smoothly and effectively conveyed and replenished to the developing device while supplying air to the toner.

However, when a large quantity of external additives are added to the toner as described above, a film of the additives added to the toner, a fine powdered toner, a paper powder of a transfer sheet, etc. is likely to adhere to the surface of the image bearing member.

Specifically, the image forming apparatus is configured such that a cleaning device removes toner and paper powder that remain on the surface of the image bearing member after a toner image is transferred to a transfer material. In this case, additives separated from the toner on the image bearing member are pressed by the cleaning device and adhere to the surface of the image bearing member. Then, finely powdered toner, paper powder, etc. stick to the pressed additives on the image bearing member. As a result, a film made of additives, finely powdered toner, paper powder, etc. (hereinafter may be simply referred to as a film of additives) adheres to the surface of the image bearing member.

If the occurrence of the aforementioned adhesion of the film of additives to the image bearing member becomes frequent, the image quality of the toner image formed on the surface of the image bearing member inevitably deteriorates.

When the above-described image forming apparatus is configured such that a toner returning device returns the toner removed by the cleaning device to the developing device for reuse in subsequent development, a toner consumption amount can be reduced, and resources can be effectively utilized.

When a mechanism for reusing toner (hereinafter referred to as a toner recycling mechanism) is employed, toner is circulated between the developing device and the cleaning device, and the external additive added to the toner typically becomes embedded in toner particles during the circulation. In this condition, the fluidity of the toner, owing to the external additive, becomes substantially lowered. For this reason, when the toner recycling mechanism is employed in the image forming apparatus, it is necessary to prevent the lowering of the fluidity of the toner due to external additive embedded in toner particles by adding a large quantity of external additives greater than the number of toner particles to the toner.

On the other hand, when a large quantity of external additives greater than the number of toner particles are added to the toner, a film made of additives added to the toner, finely powdered toner, paper powder, etc. is likely to adhere to the surface of the image bearing member as described earlier.

Referring further to the above-described image forming apparatus, a charging device charges the image bearing member, and an exposing device exposes a charged surface of the image bearing member to form an electrostatic latent image on the image bearing member.

When the charging device is configured to be applied with a voltage wherein an alternating current voltage is superimposed on a direct current voltage to charge the image bearing member, the image bearing member can be uniformly charged without a charging unevenness, even though an environmental condition (e.g., humidity, temperature, etc.) changes. As a result, high quality toner images can be formed.

However, as a result of a recent study, it has been found that the above-described film of additives is likely to adhere to the surface of the image bearing member and the wearing of the surface of the image bearing member typically advances, when a voltage wherein an alternating current voltage is superimposed on a direct current voltage is applied to the charging device, and when the toner to which a large quantity of external additives are added is used in the image forming apparatus.

SUMMARY OF THE INVENTION

The present invention has been made in view of the above-discussed and other problems, and an object of the present invention is to address these problems.

Another object of the present invention is to provide a novel image forming apparatus including a toner replenishing device that contains powdered toner and supplies air to the toner to replenish a developing device with the toner, that can prevent adhesion of a film of additives to a surface of an image bearing member and can form a high quality toner image even when a large quantity of external additives are added to the toner.

Another object of the present invention is to provide a novel image forming apparatus employing a toner recycling mechanism, that can prevent adhesion of a film of additives to a surface of an image bearing member and can form a high quality toner image even when a large quantity of external additives are added to the toner.

Another object of the present invention is to provide a novel image forming apparatus including a charging device that is applied with a voltage wherein an alternating current voltage is superimposed on a direct current voltage to charge an image bearing member, that can form a high quality toner image without adhesion of a film of additives to a surface of the image bearing member and can prevent wearing of the surface of the image bearing member and shortening of a useful life of the image bearing member even when a large quantity of external additives are added to the toner.

In order to achieve the above and other objectives, the present invention provides a novel image forming apparatus including an image bearing member on which an electrostatic latent image is formed, the image bearing member including a protective layer on a surface thereof, a developing device configured to develop the electrostatic latent image with toner to which an external additive is added to form a toner image, and a toner replenishing device configured to contain the toner and to supply air to the toner to replenish the developing device with the toner.

According to one aspect of the present invention, an image forming apparatus includes an image bearing member on which an electrostatic latent image is formed, the image bearing member including a protective layer on a surface thereof, a developing device configured to develop the electrostatic latent image with toner to form a toner image, a transfer device configured to transfer the toner image to a transfer material, a cleaning device configured to remove a toner that remains on the image bearing member after transfer of the toner image, and a toner returning device configured to return the toner removed from the image bearing member by the cleaning device to the developing device.

According to another aspect of the present invention, an image forming apparatus includes an image bearing member including a protective layer on a surface thereof, a charging device configured to be applied with a voltage wherein an alternating current voltage is superimposed on a direct current voltage to charge the image bearing member, an exposing device configured to expose a charged surface of the image bearing member to form an electrostatic latent image on the image bearing member, and a developing device configured to develop the electrostatic latent image with toner to which one part by weight or greater of an external additive is added to form a toner image.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
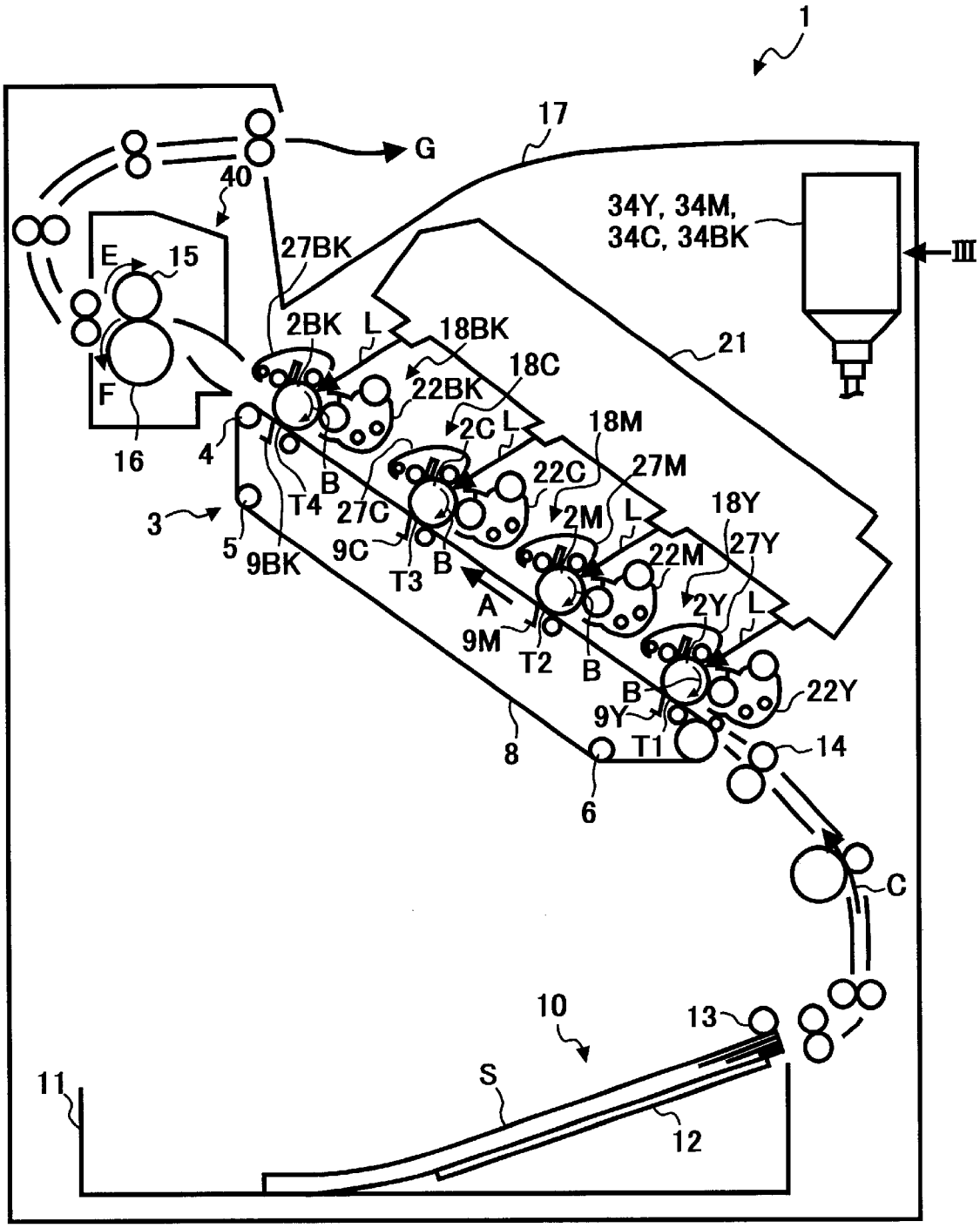
FIG. 1 is a schematic vertical sectional view illustrating an image forming apparatus according to an embodiment of the present invention.

Referring now to the drawings, wherein like reference numerals designate identical or corresponding parts throughout the several views, an embodiment of the present invention is now described. FIG. 1 is a schematic vertical sectional view of a color printer as an example of a multi-color image forming apparatus according to an embodiment of the present invention. In a multi-color image forming apparatus 1 (hereinafter simply referred to as an image forming apparatus 1), four image bearing members 2Y, 2M, 2C, 2BK constructed of drum-shaped photoreceptors are arranged along a conveying direction of a transfer material (details of which are described later) indicated by arrow A in FIG. 1 (hereinafter simply referred to as a transfer material conveying direction A).

The image forming apparatus 1 illustrated in FIG. 1 is configured such that a yellow toner image is formed on a surface of the image bearing member 2Y situated at the upstream most side of the transfer material conveying direction A, and then a magenta toner image is formed on a surface of the next image bearing member 2M, and then a cyan toner image is formed on a surface of the next image bearing member 2C, and then a black toner image is formed on a surface of the next image bearing member 2BK. The image bearing members 2Y, 2M, 2C, and 2BK are all driven to rotate in a direction indicated by arrow B.

As an alternative to the drum-shaped image bearing member, an endless belt-like image bearing member that is spanned around plural rollers and is driven to rotate may be employed. Further, as an alternative to the photoreceptor, an image bearing member including a dielectric may be employed.

At a position opposite to the image bearing members 2Y, 2M, 2C, and 2BK, a transfer material conveying device 3 is arranged. The transfer material conveying device 3 includes a plurality of supporting rollers 4, 5, 6, and 7, and a transfer belt 8 of an endless belt that is spanned around the supporting rollers 4, 5, 6, and 7. The transfer belt 8 is driven to rotate in the transfer material conveying direction A while the supporting roller 4 is driven to rotate in a counterclockwise direction in FIG. 1.

Respective image bearing members 2Y, 2M, 2C, and 2BK abut the surface of the transfer belt 8. At the position opposite to the image bearing members 2Y, 2M, 2C, and 2BK, and at the backside surface of the transfer belt 8, transfer brushes 9Y, 9M, 9C, and 9BK serving as a transfer device are respectively arranged to transfer each color toner image formed on the image bearing members 2Y, 2M, 2C, and 2BK to a transfer material. As an alternative to the transfer brush, a transfer device, such as, for example, a transfer roller, a transfer blade, or a corona discharge device may be employed.

At a lower part of the image forming apparatus 1, a cassette 11 of a sheet feeding device 10 is provided. A transfer material S is stacked on a cassette bottom plate 12 provided in the cassette 11. As the transfer material S, for example, a sheet-like flexible material, such as a transfer sheet, a resin film, a resin sheet, and a cloth, may be employed.

A top sheet of the transfer material S is fed in the direction indicated by arrow C by the counterclockwise rotation of a sheet feeding roller 13 that abuts the top sheet surface of the transfer material S. Then, the transfer material S is fed to toner image transfer stations T1, T2, T3, and T4 respectively formed between each of image bearing members 2Y, 2M, 2C, and 2BK, and the transfer belt 8, at a predetermined timing by the rotation of a pair of registration rollers 14.

As described earlier, a yellow toner image is formed on the surface of the image bearing member 2Y, and when the transfer material S passes through the toner image transfer station T1 between the image bearing member 2Y and the transfer belt 8, a transfer bias voltage having an opposite polarity to that of the charged yellow toner on the surface of the image bearing member 2Y is applied to the transfer brush 9Y. Thereby, the yellow toner image on the surface of the image bearing member 2Y is transferred to the surface of the transfer material S.

Subsequently, the transfer material S passes through the toner image transfer stations T2, T3, and T4 in order. By the application of the transfer bias voltage to the transfer brushes 9M, 9C, and 9BK at the toner image transfer stations T2, T3, and T4, respectively, each color toner image formed on the image bearing members 2M, 2C, and 2BK is sequentially transferred to the transfer material S and superimposed on the yellow toner image which has been already transferred to the transfer material S.

The transfer material S with a four-color toner image transferred thereon is conveyed to a fixing device 40. The fixing device 40 includes a fixing roller 15 and a pressure roller 16 which are driven to rotate in the directions indicated by arrows E and F, respectively. The transfer material S passes between the fixing roller 15 and the pressure roller 16, and then the four-color toner image is fused and fixed to the transfer material S by the action of heat and pressure.

Subsequently, the transfer material S is discharged from the image forming apparatus 1 in the direction indicated by arrow G in FIG. 1, and stacked on a sheet discharging tray 17 constructed of an upper wall of a main body of the image forming apparatus 1.

Each of image bearing members 2Y, 2M, 2C, and 2BK, and each of elements which form respective color toner images on the surfaces of the image bearing members 2Y, 2M, 2C, and 2BK, are integrally constructed as process units 18Y, 18M, 18C, and 18BK, respectively. Because respective structures of the process units 18Y, 18M, 18C, and 18BK are substantially the same, descriptions of a basic construction and operation of the process unit will be made only to the process unit 18BK including the image bearing member 2BK referring to FIG. 2.

Figure 2:
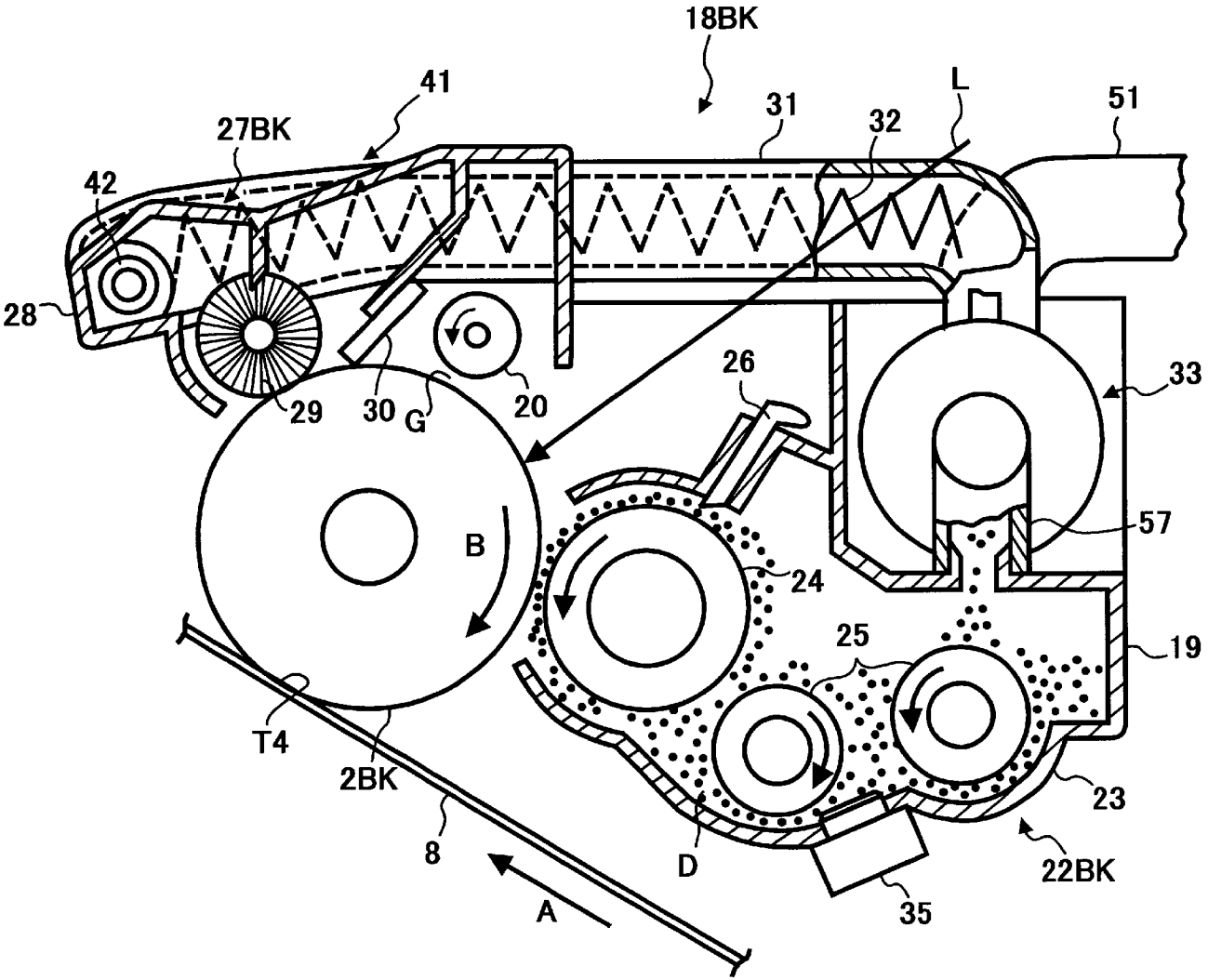
FIG. 2 is an enlarged sectional view illustrating a part of the image forming apparatus of FIG. 1.

As illustrated in FIG. 2, the image bearing member 2BK in the process unit 18BK is rotatably provided to a unit case 19 and is driven to rotate in the direction indicated by arrow B by a driving device (not shown). A charging roller 20 as a charging device is arranged at a position opposite to the surface of the image bearing member 2BK to charge the surface thereof. The charging roller 20 is rotatably supported by the unit case 19 and charges the surface of the image bearing member 2BK with a predetermined polarity while rotating. For example, the image bearing member 2BK is charged with a negative polarity according to the embodiment of the present invention.

Referring back to FIG. 1, a laser writing unit 21 as an exposing device is arranged in the image forming apparatus 1 separately from the process units 18Y, 18M, 18C, and 18BK. As illustrated in FIG. 2, the surface of the image bearing member 2BK uniformly charged by the charging roller 20 is exposed to a light-modulated laser beam L emitted from the laser writing unit 21. Thereby, an electrostatic latent image of a black image is formed on the surface of the image bearing member 2BK.

In this embodiment, a portion where an absolute value of the surface potential of the image bearing member is reduced by the irradiation with the laser beam L becomes an electrostatic latent image. On the other hand, a portion of the surface of the image bearing member which is not irradiated with the laser beam L becomes a background portion. Thus, the above-described exposing device serves to expose the charged surface of the image bearing member to form an electrostatic latent image on the image bearing member.

The above-described electrostatic latent image is visualized as a black toner image by a developing device 22BK illustrated in FIG. 2.

The developing device 22BK includes a developing case 23 that constitutes a part of the unit case 19, a developing roller 24 rotatably supported by the developing case 23 and driven to rotate in the counterclockwise direction, and a pair of agitating rollers 25 also rotatably supported by the developing case 23.

The developing case 23 accommodates a powdered two-component developer D including carrier, and black toner to which an external additive, such as, for example, silica, is added. Alternatively, a one-component developer without carrier may be employed. In the case of the one-component developer, an external additive is also added to the toner.

The above-described developer D is agitated by the agitating rollers 25, and thereby the toner and carrier of the developer D are charged by friction and have polarities opposite to each other. In this embodiment, the toner is charged with a negative polarity, and the carrier is charged with a positive polarity.

The developing roller 24 to which a bias voltage of a negative polarity is applied bears the developer D on the surface thereof, and a regulating blade 26 regulates an amount of the developer D on the surface of the developing roller 24. When the developer D is carried to a developing area between the developing roller 24 and the image bearing member 2BK, the black toner in the developer D is electrostatically attracted to an electrostatic latent image formed on the surface of the image bearing member 2BK. Thereby, the electrostatic latent image is visualized as a black toner image.

When a toner density detecting sensor 35 detects a lowering of toner density of the two-component developer D accommodated in the developing case 23, toner is replenished to the two-component developer D in the developing case 23 (details of which are described later).

As described earlier, the black toner image on the image bearing member 2BK is transferred to the surface of the transfer material S. A cleaning device 27BK removes a toner that remains on the surface of the image bearing member 2BK after transfer of the black toner image.

The cleaning device 27BK includes a cleaning case 28 that constitutes a part of the unit case 19, a cleaning brush 29 rotatably supported by the cleaning case 28 and driven to rotate, and a cleaning blade 30 whose base end portion is fixed to the cleaning case 28. The cleaning brush 29 and the cleaning blade 30 abut the surface of the image bearing member 2BK to remove a residual toner from the surface of the image bearing member 2BK. The cleaning brush 29 and the cleaning blade 30 are examples of a cleaning member that cleans the surface of the image bearing member.

The configurations of the process units 18Y, 18M, and 18C are substantially the same as that of the process unit 18BK except that respective two-component developer including yellow toner and carrier, magenta toner and carrier, and cyan toner and carrier, are accommodated in each developing case of the developing devices 22Y, 22M, and 22C, and that a yellow toner image, a magenta toner image, and a cyan toner image are formed on the image bearing members 2Y, 2M, and 2C, respectively.

Similarly as for the black toner, external additives are added to the yellow, magenta, and cyan toner.

As illustrated in FIG. 1, in order to distinguish developing devices and cleaning devices of respective process units by color toner, the developing devices are indicated by the reference characters 22Y, 22M, 22C, and 22BK, and the cleaning devices are indicated by the reference characters 27Y, 27M, 27C, and 27BK.

By employing a toner recycling mechanism in the above-described image forming apparatus 1, a toner consumption amount can be reduced, and resources can be effectively utilized. A reference will be made to the toner recycling mechanism employed in the image forming apparatus 1 referring to FIG. 2.

As illustrated in FIG. 2, the process unit 18BK includes a toner returning device 41. The toner returning device 41 includes a toner returning duct 31 through which the removed toner passes to return to the developing device 22BK from the cleaning case 28 of the cleaning device 27BK, a toner conveying screw 32 as a toner conveying member provided in the toner returning duct 31, and a driving device (not shown) which drives the toner conveying screw 32 to rotate.

The toner removed from the image bearing member 2BK by the cleaning brush 29 and the cleaning blade 30 is conveyed from the cleaning case 28 to the toner returning duct 31 by a toner discharging screw 42 that is driven to rotate in the cleaning case 28.

The toner conveyed to the toner returning duct 31 is further conveyed in the toner returning duct 31 by the toner conveying screw 32 which is driven to rotate by the above-described driving device (not shown). Subsequently, the toner conveyed in the toner returning duct 31 is returned to the developing case 23 of the developing device 22BK via a toner conveying device 33 (details of which are described later). The returned toner is reused to develop an electrostatic latent image formed on the image bearing member 2BK.

Thus, the toner returning device 41 serves to return the toner removed from the image bearing member by the cleaning device to the developing device so as to re-use the toner for developing an electrostatic latent image formed on the image bearing member.

Similarly as for the process unit 18BK, process units 18Y, 18M, and 18C include toner returning devices (not shown) having similar configurations to the above-described toner returning device 41. Respective toner returning devices in the process units 18Y, 18M, and 18C are configured to return each color toner collected by the cleaning devices 27Y, 27M, and 27C to the developing devices 22Y, 22M, and 22C, respectively, to re-use each color toner for development.

As described above, the image forming apparatus according to the embodiment of the present invention includes an image bearing member on which an electrostatic latent image is formed, a charging device that charges the image bearing member, an exposing device that exposes a charged surface of the image bearing member to form an electrostatic latent image on the image bearing member, a developing device that develops the electrostatic latent image with toner to form a toner image, a transfer device that transfers the toner image to a transfer material, a cleaning device that removes a toner that remains on the image bearing member after transfer of the toner image, and a toner returning device that returns the toner removed from the image bearing member by the cleaning device to the developing device.

When the toner density detecting sensor 35 detects the lowering of toner density of the two-component developer D accommodated in the developing case 23, a toner replenishing device replenishes the developing devices 22Y, 22M, 22C, and 22BK with the toner.

Figure 3:
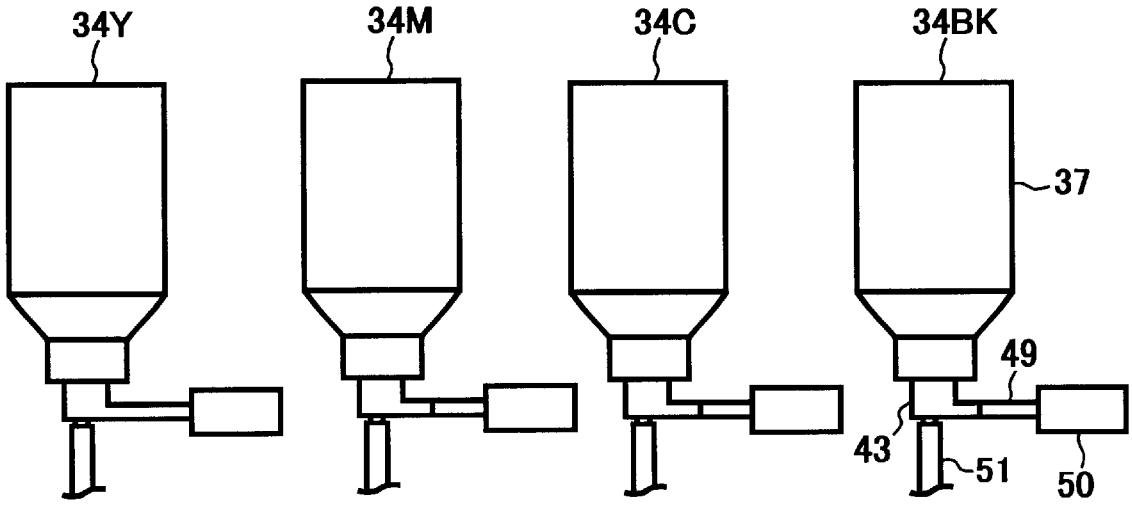
FIG. 3 is a schematic view illustrating toner containers seen from the direction indicated by arrow III of FIG. 1.

The developing devices 22Y, 22M, 22C, and 22BK include respective toner replenishing devices. The toner replenishing devices respectively include toner containers 34Y, 34M, 34C, and 34BK illustrated in FIGS. 1 and 3, and the toner conveying devices 33 illustrated in FIGS. 2 and 5.

Because respective structures of the above-described toner replenishing devices are substantially the same, descriptions of a basic construction and operation will be made only to the toner replenishing device that replenishes the developing device 22BK with black toner.

Figure 4:
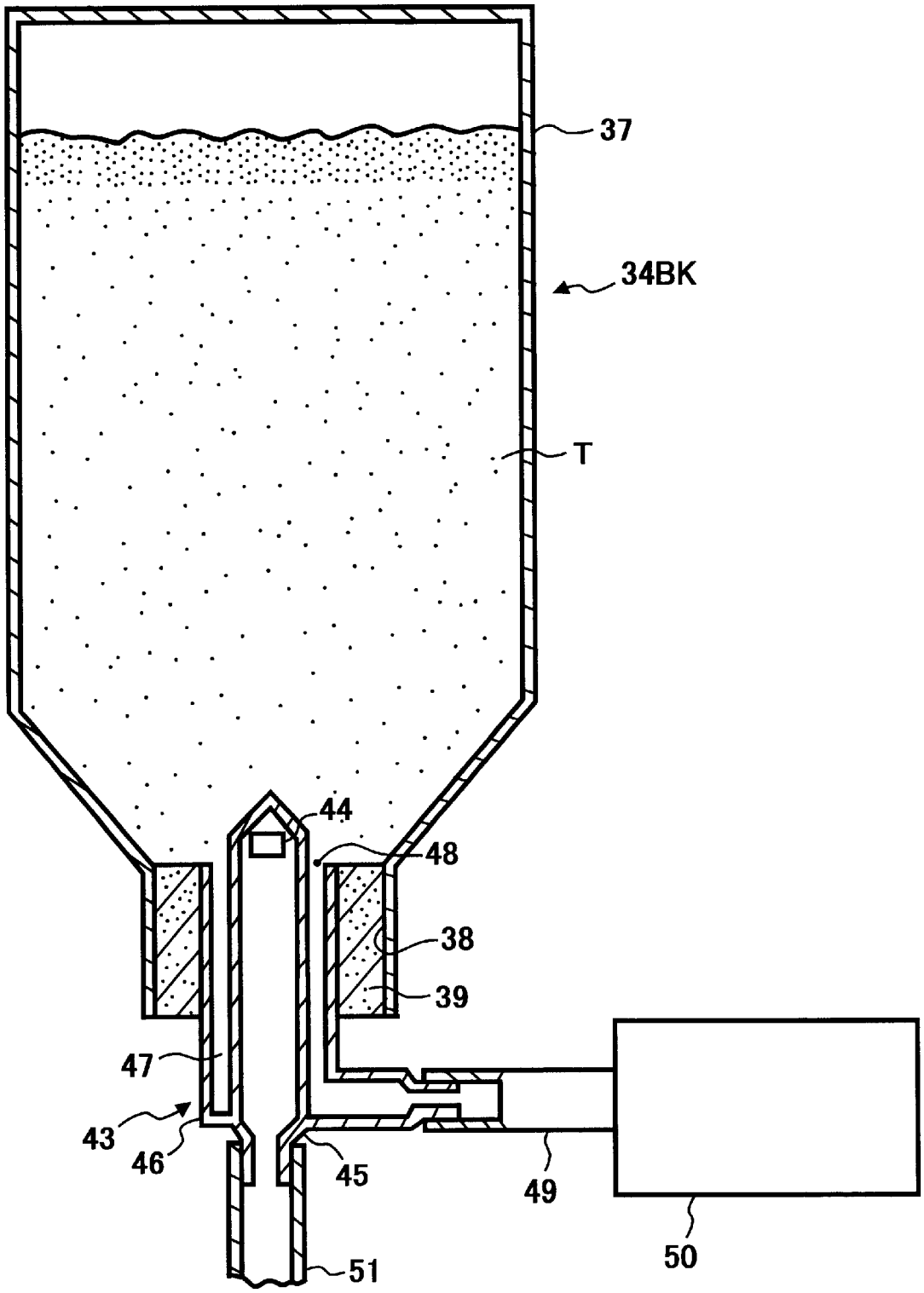
FIG. 4 is an enlarged sectional view illustrating the toner container of the present invention.

As illustrated in FIG. 4, the toner container 34BK includes a container case 37 made of, for example, a resin, and a toner sealing member 39 provided at an opening 38 of the container case 37. The toner sealing member 39 is made of a closed-cell foam material. The container case 37 accommodates a powdered black toner T.

In order to increase fluidity of toner, external additives, such as, for example, powdered external additives including fine particles of silica, or other similar external additives, are added to the black toner T.

As the container case 37, various kinds of cases, such as, for example, a hard case having high rigidity, and a flexible case constructed of a flexible bag, can be employed.

A nozzle 43 is provided at a main body side of the image forming apparatus 1, and includes a toner discharging tube 45 wherein a toner outlet 44 is formed at one end side of the toner discharging tube 45, and a nozzle tube 46 integrally fixed to the toner discharging tube 45.

Between the toner discharging tube 45 and the nozzle tube 46, an annular air flowing path 47 is provided. An air outlet 48 provided at one end of the nozzle tube 46 is opened for the inside of the container case 37. To the other end of the nozzle tube 46, one end of an air supply tube 49 is connected. Further, the other end of the air supply tube 49 is connected to an air discharging opening of an air pump 50 installed to the main body of the image forming apparatus 1. Moreover, to the other end of the toner discharging tube 45, one end of a toner supply tube 51 is connected.

The toner container 34BK is detachably installed to the nozzle 43. Specifically, the toner container 34BK is detached from the nozzle 43 by lifting the toner container 34BK. By the reverse operation, the toner container 34BK is installed to the nozzle 43 as illustrated in FIG. 4.

When the toner density detecting sensor 35 (illustrated in FIG. 2) detects the lowering of the toner density of the two-component developer D deposited in the developing device 22BK, the air pump 50 illustrated in FIG. 4 operates to discharge air. The air is sent to the nozzle tube 46 through the air supply tube 49, and passes through the air flowing path 47. Then the air is supplied to the inside of the container case 37 through the air outlet 48.

By supplying the air to the inside of the container case 37 as described above, the powdered black toner T in the container case 37 is fluidized, and the pressure in the container case 37 is raised.

Figure 5:
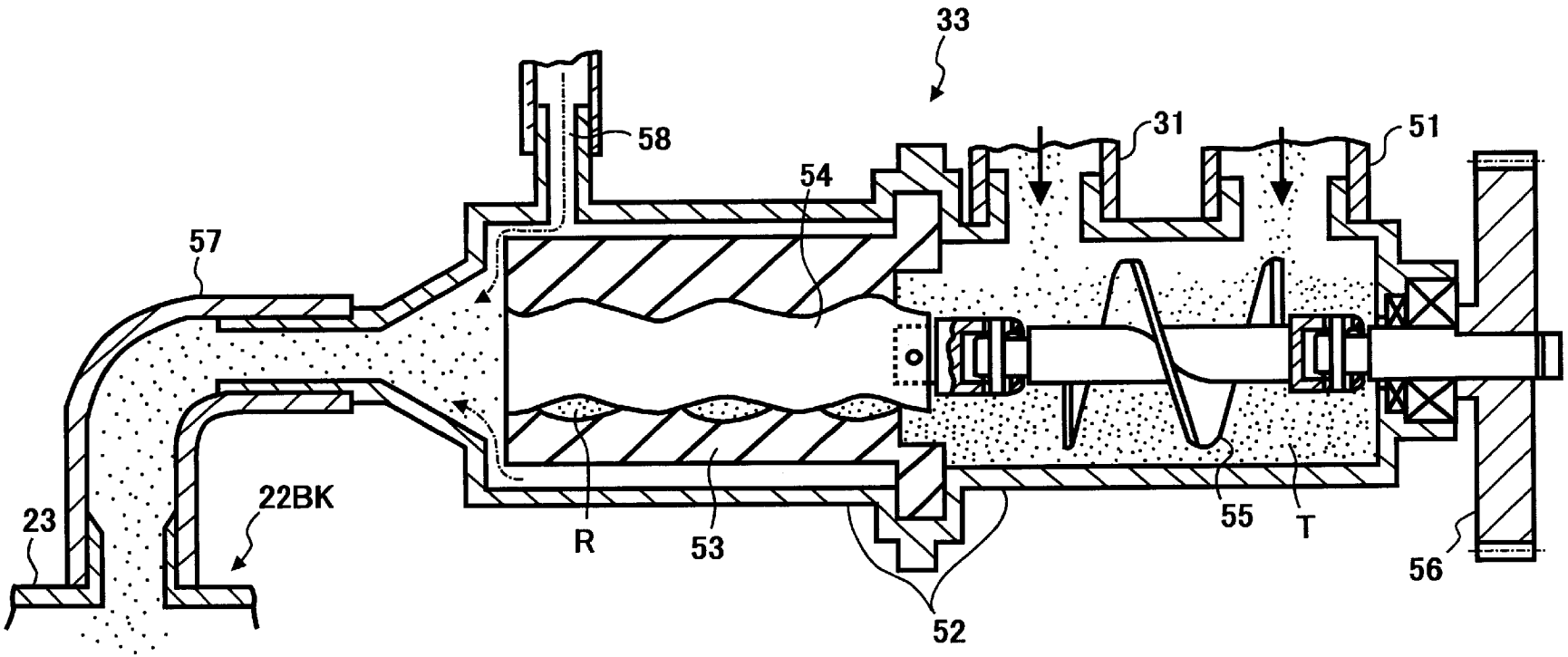
FIG. 5 is a longitudinal sectional view illustrating a toner conveying device of the present invention.

As the pressure in the container case 37 is increased, the fluidized toner powder is discharged from the toner container 34BK through the toner outlet 44 of the toner discharging tube 45 with the cooperation of the toner conveying device 33 illustrated in FIGS. 2 and 5.

The discharged black toner T is conveyed in the toner discharging tube 45 and the toner supply tube 51 with air, and is sent out to the toner conveying device 33.

As illustrated in FIG. 5, the toner conveying device 33 includes a stator 53 fixed in a casing 52, and a rotor 54 rotatably arranged in a central opening of the stator 53. On the internal circumference surface of the stator 53 is formed a spiral groove having two stripes. The rotor 54 is eccentric with respect to a central axis thereof and extends in a spiral around the central axis. With the above-described configurations of the stator 53 and the rotor 54, space R for conveying toner is formed between the rotor 54 and the internal circumference surface of the stator 53.

The rotor 54 connects to a screw conveyer 55 rotatably arranged in the casing 52. Further, the screw conveyer 55 connects to a gear 56. The toner supply tube 51 illustrated in FIG. 4 connects to an opening of the casing 52 where the screw conveyer 55 is provided as illustrated in FIG. 5. Further, the toner returning duct 31 of the toner returning device 41 connects to another opening of the casing 52.

As described above, when the toner density detecting sensor 35 detects the lowering of the toner density of the two-component developer D deposited in the developing device 22BK, the air pump 50 illustrated in FIG. 4 starts to operate, and the screw conveyer 55 and the rotor 54 start to rotate while the gear 56 of the toner conveying device 33 of FIG. 5 is driven to rotate.

Thereby, the black toner T sent out to the casing 52 through the toner supply tube 51 is further sent out to the space R between the rotor 54 and the stator 53 by the screw conveyer 55. Then, the black toner T is conveyed in a left direction as seen in FIG. 5 by the rotation of the rotor 54, and is supplied to the inside of the developing case 23 of the developing device 22BK through a discharging tube 57 connected to the casing 52.

In addition, the residual black toner collected by the cleaning device 27BK and sent out to the casing 52 through the toner returning duct 31 is also supplied to the inside of the developing case 23 of the developing device 22BK together with the above-described black toner T.

In order to further increase the fluidity of the black toner in the casing 52, the air supplied from the air pump 50 of FIG. 4 can be guided to the inside of the casing 52 through an air taking-in opening 58 and can be supplied to the black toner.

After the above-described toner replenishing operations are performed for a predetermined time, the toner replenishing operations stop. The above-described toner replenishing operations are performed every time the toner density detecting sensor 35 detects the lowering of the toner density of the two-component developer D deposited in the developing device 22BK. Thus, the toner density of the two-component developer D is kept within a predetermined range.

In the developing device 22BK, a filter (not shown) is provided with the developing case 23. The air sent out to the developing device 22BK with toner is discharged from the developing device 22BK through the filter.

The configuration of each of the toner replenishing devices for the developing devices 22Y, 22M, and 22C are substantially the same as that of the toner replenishing device for the developing device 22BK except that yellow, magenta, and cyan toner to which external additives are added are contained in the toner containers 34Y, 34M, and 34C, respectively.

As described above, the toner replenishing device is configured to contain powdered toner to which an external additive is added and to supply air to the toner to replenish the developing device with the toner. The toner replenishing device according to the embodiment of the present invention includes a toner container to contain the toner and a device to supply the air to an inside of the toner container to discharge the toner therefrom. The toner replenishing device further includes a toner conveying device configured to convey the toner discharged from the toner container to the developing device.

Owing to the above-described configuration of the toner replenishing device, the fluidity of the powdered toner can be increased, and the toner can be effectively and smoothly conveyed and replenished to the developing device.

The configuration of the toner replenishing device is not limited to the one described referring to FIGS. 4 and 5, but various kinds of configurations can be employed. For example, the toner replenishing device can be configured without the toner conveying device.

Alternatively, it can be configured that the residual toner collected by the cleaning device is directly returned to the developing device without passing through the toner conveying device.

According to the embodiment of the present invention, because the toner is replenished to the developing device from the toner container provided at a distance from the developing device through the toner replenishing device, a space between the toner container and the developing device can be effectively used in the image forming apparatus 1. Therefore, the elements of the image forming apparatus 1 can be designed with numerous layouts.

In the image forming apparatus 1 illustrated in FIG. 1, the toner containers 34Y, 34M, 34C, and 34BK are provided in a space above the laser writing unit 21 situated diagonally to the upper of the process units 18Y, 18M, 18C, and 18BK. It is configured that each color toner is supplied from the toner containers 34Y, 34M, 34C, and 34BK to the developing devices 22Y, 22M, 22C, and 22BK, respectively.

When the above-described toner replenishing device is provided, a large quantity of external additives need to be added to the toner so as to increase the fluidity of the toner for smooth conveyance. In such the case, additives separated from the toner on the image bearing member are likely to be pressed by the cleaning brush and the cleaning blade of the cleaning device and adhere to the surface of the image bearing member. Then, finely powdered toner, paper powder, etc. stick to the pressed additives on the image bearing member. As a result, a film made of additives, finely powdered toner, paper powder, etc. (hereinafter may be simply referred to as a film of additives) adheres to the surface of the image bearing member.

Figure 6:
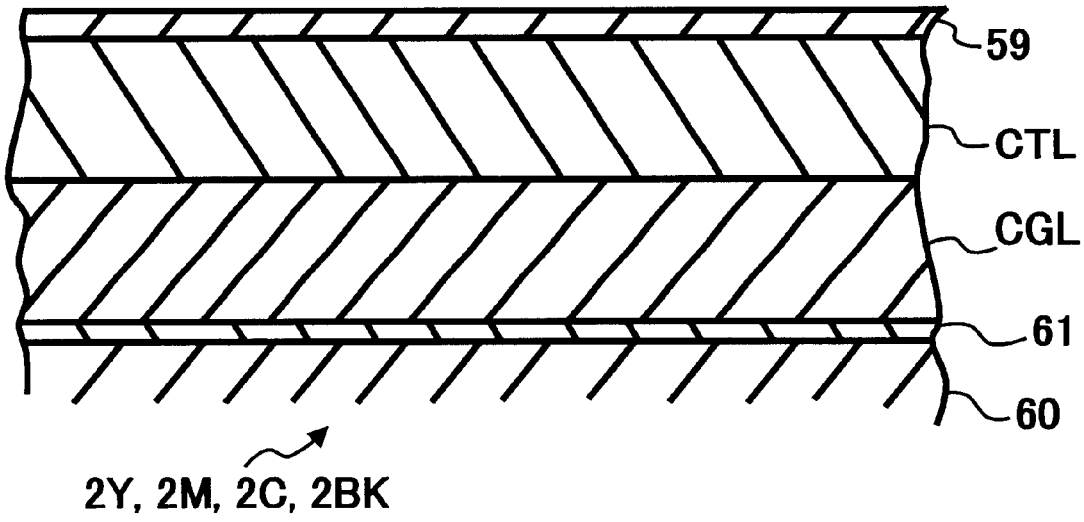
FIG. 6 is a schematic enlarged view illustrating a cross-section of an image bearing member of the image forming apparatus of the present invention.

In order to avoid the adhesion of the film of additives to the surface of the image bearing member, a protective layer is formed on each surface of the image bearing members 2Y, 2M, 2C, and 2BK in the image forming apparatus 1. FIG. 6 is a schematic enlarged view illustrating a cross-section of the image bearing members 2Y, 2M, 2C, and 2BK. A protective layer 59 is formed on each surface of the image bearing members 2Y, 2M, 2C, and 2BK as illustrated in FIG. 6.

It is preferable that the protective layer 59 should include a binder resin including, for example, a polycarbonate, and a fine particulate material of high-hardness, such as, alumina, silica, etc. dispersed in the binder resin.

Further, each image bearing member 2Y, 2M, 2C, and 2BK illustrated in FIG. 6 is constituted of a layered organic photoreceptor including a conductive base 60, an intermediate layer 61 formed on the conductive base 60, a charge generation layer CGL formed on the intermediate layer 61, and a charge transport layer CTL formed on the charge generation layer CGL.

It is preferable that the protective layer 59 should be integrally formed on the surface of the charge transport layer CTL and should include a binder resin including, such as, for example, a polycarbonate, and a charge transport material and a fine particulate material of high hardness, such as, alumina, silica, etc., dispersed in the binder resin.

Owing to the above-described protective layer 59 formed on each surface of the image bearing members 2Y, 2M, 2C, and 2BK, even though a large quantity of external additives are added to the toner, the additives separated from the toner and pressed by the cleaning device on the image bearing member are not likely to adhere to the respective surfaces of the image bearing members 2Y, 2M, 2C, and 2BK. As a result, the adhesion of the film of additives to the respective surfaces of the image bearing members 2Y, 2M, 2C, and 2BK can be effectively avoided, so that deterioration of the quality of the toner image formed on each image bearing member 2Y, 2M, 2C, and 2BK can be prevented.

Further, owing to the fine particulate material of high-hardness included in the protective layer 59, the advantage is obtained that the abrasion resistance of the surfaces of the image bearing members 2Y, 2M, 2C, and 2BK can be increased. As a result, the useful life of the image bearing members 2Y, 2M, 2C, and 2BK can be extended.

As described earlier, the toner returning device 41, i.e., the toner recycling mechanism, is employed in the image forming apparatus 1. When the toner recycling mechanism is employed, a large quantity of external additives also need to be added to toner so as to avoid the lowering of fluidity of toner. As a result, a film of additives is likely to adhere to a surface of an image bearing member.

However, even though the toner recycling mechanism is employed and a large quantity of external additives are added to the toner, because the above-described protective layer 59 is formed on the respective surfaces of the image bearing members 2Y, 2M, 2C, and 2BK, the adhesion of the film of additives to each surface of the image bearing members 2Y, 2M, 2C, and 2BK can be effectively avoided. As a result, deterioration of the quality of the toner image formed on each image bearing member 2Y, 2M, 2C, and 2BK can be prevented.

Moreover, when the amount of external additives added to the toner is increased, it can prevent toner from being aggregated during the circulation between the developing devices 22Y, 22M, 22C, and 22BK, and the cleaning devices 27Y, 27M, 27C, and 27BK, respectively. Consequently, deterioration of toner image quality can be also avoided.

In the above-described image forming apparatus 1, the charging roller 20 is employed as a charging device to charge surfaces of the image bearing members 2Y, 2M, 2C, and 2BK.

When the charging device is configured to be applied with a voltage wherein an alternating current voltage is superimposed on a direct current voltage to charge an image bearing member, the surface of the image bearing member can be uniformly charged without being affected by the change of environmental conditions (e.g., humidity, temperature, etc.), so that charging unevenness can be prevented.

On the other hand, when a voltage wherein an alternating current voltage is superimposed on a direct current voltage is applied to the charging device, the surface of the image bearing member is likely to be worn, so that the useful life of the image bearing member may be shortened.

Moreover, when a voltage wherein an alternating current voltage is superimposed on a direct current voltage is applied to the charging device, and when the developing device is configured to develop an electrostatic latent image with toner to which one part by weight or greater of an external additive is added to form a toner image, the film of additives is likely to adhere to the surface of the image bearing member.

Even in such the cases, because the protective layer 59 is formed on the surface of image bearing member as described above, the wear of the surface of the image bearing member and the adhesion of the film of additives to the surface of the image bearing member can be avoided. As a result, the shortening of the useful life of the image bearing member can be avoided, and a high quality toner image can be formed on the image bearing member.

As an alternative to the charging roller 20, a charging blade, a charging belt, or similar charging devices may be employed. Although the charging device can be configured to contact the surface of the image bearing member, the charging device can be also configured to be as a non-contact type charging device that is spaced apart from the surface of the image bearing member.

In the process unit 18BK illustrated in FIG. 2, the charging roller 20 is spaced apart from the surface of the image bearing member 2BK by a gap G of about 50 $\mu$m. By separating the charging device from the surface of the image bearing member, the residual toner on the surface of the image bearing member which the cleaning device can not remove is prevented from attaching to the charging device, so that the charging device is prevented from being stained by the residual toner. As a result, the useful life of the charging device can be extended.

When the charging device is arranged in a non-contacting relation to the surface of the image bearing member, it is difficult to precisely control the gap G (e.g., 50 $\mu$m) between the charging device and the surface of the image bearing member. However, when a voltage wherein an alternating current voltage is superimposed on a direct current voltage is applied to the charging device, the image bearing member can be uniformly charged even if the gap G is not uniform.

In the image forming apparatus 1 according to the embodiment of the present invention, the charging device is applied with a voltage wherein an alternating current voltage is superimposed on a direct current voltage, and toner to which one part by weight or greater of an external additive is added is used. Accordingly, the above-described toner replenishing device is configured to contain powdered toner to which one part by weight or greater of an external additive is added and to supply air to the toner to replenish the developing device with the toner.

Moreover, in the image forming apparatus 1 according to the embodiment of the present invention, even when the toner replenishing device and the toner returning device are provided in the image forming apparatus 1, the adhesion of the film of additives to the surface of the image bearing member can be effectively avoided.

As described above, the present invention is applied to the image forming apparatus including a plurality of the image bearing members arranged along a conveying direction of a transfer material, and a plurality of the developing devices, the transfer devices, and the cleaning devices which are arranged for each of the image bearing members.

Alternatively, the present invention can be also applied to an image forming apparatus wherein one image bearing member is employed, and a toner image on the image bearing member is transferred to an intermediate transfer member, and is then transferred to a transfer material from the intermediate transfer member.

Moreover, the present invention can be applied not only to a printer but also to similar image forming apparatuses.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-077297 filed in the Japanese Patent Office on Mar. 17, 2000, and the entire contents of which are hereby incorporated by reference.

What is claimed as new and is desired to be secured by Letters Patent of the United States is:

1. An image forming apparatus, comprising:

an image bearing member on which an electrostatic latent image may be formed, the image bearing member including a protective layer on a surface thereof, wherein the protective layer comprises inorganic ceramic particulates;

a developing device configured to develop an electrostatic latent image formed on the image bearing member with toner to which an external additive is added; and a toner replenishing device including, a toner container configured to contain the toner, a toner conveying device configured to convey the toner discharged from the toner container to the developing device, and an air supplying device configured to supply air to an inside of the toner container so as to discharge the toner together with the air into the toner replenishing device, and to supply air to the toner conveying device.

2. An image forming apparatus, comprising:

an image bearing member on which an electrostatic latent image may be formed, the image bearing member including a protective layer on a surface thereof, wherein the protective layer comprises inorganic ceramic particulates;

a developing device configured to develop an electrostatic latent image formed on the image bearing member with toner to form a toner image;

a toner replenishing device including, a toner container configured to contain the toner, a toner conveying device configured to convey the toner discharged from the toner container to the developing device, and an air supplying device configured to supply air to an inside of the toner container so as to discharge the toner together with the air into the toner replenishing device, and to supply air to the toner conveying device;

a transfer device configured to transfer the toner image to a transfer material;

a cleaning device configured to remove a toner that remains on the image bearing member after transfer of the toner image; and a toner returning device configured to return toner removed from the image bearing member by the cleaning device to the developing device.

3. An image forming apparatus, comprising:

an image bearing member including a protective layer on a surface thereof, wherein the protective layer comprises inorganic ceramic particulates;

a charging device configured to be applied with a voltage wherein an alternating current voltage is superimposed on a direct current voltage to charge the image bearing member;

an exposing device configured to expose a charged surface of the image bearing member to form an electrostatic latent image on the image bearing member;

a developing device configured to develop the electrostatic latent image with toner to which one part by weight or greater of an external additive is added, to form a toner image; and a toner replenishing device including, a toner container configured to contain the toner, a toner conveying device configured to convey the toner discharged from the toner container to the developing device, and an air supplying device configured to supply air to an inside of the toner container so as to discharge the toner together with the air into the toner replenishing device, and to supply air to the toner conveying device.

4. The image forming apparatus according to claim 3, wherein the charging device is spaced apart from the image bearing member.

5. The image forming apparatus according to claim 3, further comprising:

a transfer device configured to transfer the toner image to a transfer material;

a cleaning device configured to remove a toner that remains on the image bearing member after transfer of the toner image; and a toner returning device configured to return the toner removed from the image bearing member by the cleaning device to the developing device.

6. The image forming apparatus according to claim 3, further comprising:

a transfer device configured to transfer the toner image to a transfer material;

a cleaning device configured to remove a toner that remains on the image bearing member after transfer of the toner image; and a toner returning device configured to return the toner removed from the image bearing member by the cleaning device to the developing device.

7. The image forming apparatus according to claim 1, wherein the protective layer includes a binder resin and a fine particulate material dispersed in the binder resin.

8. The image forming apparatus according to claim 2, wherein the protective layer includes a binder resin and a fine particulate material dispersed in the binder resin.

9. The image forming apparatus according to claim 3, wherein the protective layer includes a binder resin and a fine particulate material dispersed in the binder resin.

10. The image forming apparatus according to claim 1, wherein the image bearing member is constituted of a layered organic photoreceptor including a charge generation layer and a charge transport layer formed on the charge generation layer, and wherein the protective layer is formed on a surface of the charge transport layer and includes a binder resin, and a charge transport material and a fine particulate material dispersed in the binder resin.

11. The image forming apparatus according to claim 2, wherein the image bearing member is constituted of a layered organic photoreceptor including a charge generation layer and a charge transport layer formed on the charge generation layer, and wherein the protective layer is formed on a surface of the charge transport layer and includes a binder resin, and a charge transport material and a fine particulate material dispersed in the binder resin.

12. The image forming apparatus according to claim 3, wherein the image bearing member is constituted of a layered organic photoreceptor including a charge generation layer and a charge transport layer formed on the charge generation layer, and wherein the protective layer is formed on a surface of the charge transport layer and includes a binder resin, and a charge transport material and a fine particulate material dispersed in the binder resin.

13. The image forming apparatus according to claim 1, wherein a plurality of the image bearing members are arranged along a conveying direction of a transfer material, and wherein the developing device and the toner replenishing device are arranged for each of the image bearing members.

14. The image forming apparatus according to claim 2, wherein a plurality of the image bearing members are arranged along a conveying direction of a transfer material, and wherein the developing device, the transfer device, the cleaning device, and the toner returning device are arranged for each of the image bearing members.

15. The image forming apparatus according to claim 3, wherein a plurality of the image bearing members are arranged along a conveying direction of a transfer material, and wherein the charging device and the developing device are arranged for each of the image bearing members, and wherein the exposing device is configured to expose each charged surface of the image bearing members.

16. An image forming apparatus, comprising:

means for bearing an electrostatic latent image thereupon, the image bearing means including a protective layer on a surface thereof, wherein the protective layer comprises inorganic ceramic particulates;

means for developing the electrostatic latent image with toner to which an external additive is added, to form a toner image;

means for replenishing the developing means with the toner, the replenishing means includes, toner container means for containing the toner, toner conveying means for conveying the toner discharged from the toner container means to the developing means, and air supplying means for supplying air to an inside of the toner container means so as to discharge the toner together with the air into the toner replenishing means, and for supplying air to the toner conveying means.

17. An image forming apparatus, comprising:

means for bearing an electrostatic latent image thereupon, the image bearing means including a protective layer on a surface thereof, wherein the protective layer comprises inorganic ceramic particulates;

means for developing the electrostatic latent image with toner to form a toner image;

means for replenishing the developing means with the toner, the replenishing means includes, toner container means for containing the toner, toner conveying means for conveying the toner discharged from the toner container means to the developing means, and air supplying means for supplying air to an inside of the toner container means so as to discharge the toner together with the air into the toner replenishing means, and for supplying air to the toner conveying means;

means for transferring the toner image to a transfer material;

means for removing a toner that remains on the image bearing means after transfer of the toner image; and means for returning the toner removed from the image bearing means by the removing means to the developing means.

18. An image forming apparatus, comprising:

means for bearing an image, the image bearing means including a protective layer on a surface thereof, wherein the protective layer comprises inorganic ceramic particulates;

means for charging the image bearing means, the charging means being applied with a voltage wherein an alternating current voltage is superimposed on a direct current voltage;

means for exposing a charged surface of the image bearing means to form an electrostatic latent image on the image bearing means;

means for developing the electrostatic latent image with toner to which one part by weight or greater of an external additive is added, to form a toner image; and means for replenishing the developing means with the toner, wherein the replenishing means includes, toner container means for containing the toner, toner conveying means for conveying the toner discharged from the toner container means to the developing means, and air supplying means for supplying air to an inside of the toner container means so as to discharge the toner together with the air into the toner replenishing means, and for supplying air to the toner conveying means.

19. The image forming apparatus according to claim 18, wherein the charging means is spaced apart from the image bearing means.

20. The image forming apparatus according to claim 18, further comprising:

means for replenishing the developing means with the toner, the replenishing means containing the toner and supplying air to the toner.

21. The image forming apparatus according to claim 18, further comprising:

means for transferring the toner image to a transfer material;

means for removing a toner that remains on the image bearing means after transfer of the toner image; and means for returning the toner removed from the image bearing means by the removing means to the developing means.

22. The image forming apparatus according to claim 20, further comprising:

means for transferring the toner image to a transfer material;

means for removing a toner that remains on the image bearing means after transfer of the toner image; and means for returning the toner removed from the image bearing means by the removing means to the developing means.

23. The image forming apparatus according to claim 16, wherein the replenishing means includes means for containing the toner and means for supplying the air to an inside of the containing means, to discharge the toner therefrom.

24. The image forming apparatus according to claim 20, wherein the replenishing means includes means for containing the toner and means for supplying the air to an inside of the containing means, to discharge the toner therefrom.

25. The image forming apparatus according to claim 23, wherein the replenishing means further includes means for conveying the toner discharged from the containing means to the developing means.

26. The image forming apparatus according to claim 24, wherein the replenishing means further includes means for conveying the toner discharged from the containing means to the developing means.

27. The image forming apparatus according to claim 16, wherein the protective layer includes a binder resin and a fine particulate material dispersed in the binder resin.

28. The image forming apparatus according to claim 17, wherein the protective layer includes a binder resin and a fine particulate material dispersed in the binder resin.

29. The image forming apparatus according to claim 18, wherein the protective layer includes a binder resin and a fine particulate material dispersed in the binder resin.

30. The image forming apparatus according to claim 16, wherein the image bearing means comprises a layered organic photoreceptor including a charge generation layer and a charge transport layer formed on the charge generation layer, and wherein the protective layer is formed on a surface of the charge transport layer and includes a binder resin, and a charge transport material and a fine particulate material dispersed in the binder resin.

31. The image forming apparatus according to claim 17, wherein the image bearing means comprises a layered organic photoreceptor including a charge generation layer and a charge transport layer formed on the charge generation layer, and wherein the protective layer is formed on a surface of the charge transport layer and includes a binder resin, and a charge transport material and a fine particulate material dispersed in the binder resin.

32. The image forming apparatus according to claim 18, wherein the image bearing means comprises a layered organic photoreceptor including a charge generation layer and a charge transport layer formed on the charge generation layer, and wherein the protective layer is formed on a surface of the charge transport layer and includes a binder resin, and a charge transport material and a fine particulate material dispersed in the binder resin.

33. The image forming apparatus according to claim 16, wherein a plurality of the image bearing means are arranged along a conveying direction of a transfer material, and wherein the developing means and the replenishing means are arranged for each of the image bearing means.

34. The image forming apparatus according to claim 17, wherein a plurality of the image bearing means are arranged along a conveying direction of a transfer material, and wherein the developing means, the transferring means, the cleaning means, and the returning means are arranged for each of the image bearing means.

35. The image forming apparatus according to claim 18, wherein a plurality of the image bearing means are arranged along a conveying direction of a transfer material, and wherein the charging means and the developing means are arranged for each of the image bearing means, and wherein the exposing means exposes each charged surface of the image bearing means.

36. A method of forming an image in an image forming apparatus, comprising:

bearing an electrostatic latent image on an image bearing member including a protective layer on a surface thereof, wherein the protective layer comprises inorganic ceramic particulates;

developing the electrostatic latent image with toner to which an external additive is added to form a toner image with a developing device; and replenishing the developing device with the toner by supplying air to the toner contained in a toner container which discharges the toner together with the air into a toner conveying device and to a toner conveying device.

37. A method of forming an image in an image forming apparatus, comprising:

bearing an electrostatic latent image on an image bearing member including a protective layer on a surface thereof, wherein the protective layer comprises inorganic ceramic particulates;

replenishing the developing device with the toner by supplying air to the toner contained in a toner container and to a toner conveying device and by discharging the toner together with the air into a toner conveying device;

developing the electrostatic latent image with toner to form a toner image with the developing device;

transferring the toner image to a transfer material;

removing a toner that remains on the image bearing member by a cleaning device after transferring the toner image; and returning the toner removed from the image bearing member by the cleaning device to the developing device.

38. A method of forming an image in an image forming apparatus, comprising:

applying a voltage wherein an alternating current voltage is superimposed on a direct current voltage to a charging device to charge an image bearing member including a protective layer on a surface thereof, wherein the protective layer comprises inorganic ceramic particulates;

exposing a charged surface of the image bearing member to form an electrostatic latent image on the image bearing member;

replenishing the developing device with the toner by supplying air to the toner contained in a toner container and to a toner conveying device and by discharging the toner together with the air into a toner conveying device; and developing the electrostatic latent image with toner to which one part by weight or greater of an external additive is added to form a toner image with developing device.

39. The method of claim 36, wherein:

the replenishing of the developing device with the toner includes supplying air to an inside of a toner container to discharge toner from the toner container.

40. The method of claim 39, wherein:

the replenishing of the developing device with the toner further includes conveying the toner discharged from the toner container to the developing device.

* * * * *